US005406168A

United States Patent [19]

Takagi

[11] Patent Number: 5,406,168

[45] Date of Patent: Apr. 11, 1995

[54] COLOR PICTURE TUBE GRID APPARATUS HAVING A COLOR GRID WITH SLIT HOLES

[75] Inventor: Kouji Takagi, Tokyo, Japan

[73] Assignee: NEC Corporation, Tokyo, Japan

[21] Appl. No.: 974,958

[22] Filed: Nov. 12, 1992

[30] Foreign Application Priority Data

Nov. 20, 1991 [JP] Japan ..... 3-331467

[51] Int. Cl.[6] ..... H01J 29/02

[52] U.S. Cl. ..... 313/402; 313/404; 313/407; 313/269

[58] Field of Search ..... 313/402, 404, 407, 269, 313/403, 348

[56] References Cited

U.S. PATENT DOCUMENTS 3,638,063 1/1972 Tachikawa et al. ..... 313/269
4,504,764 3/1985 Sakamoto et al. ..... 313/269
4,605,878 8/1986 Saita et al. ..... 313/404
4,780,641 10/1988 Hashiba et al. ..... 313/269
5,179,317 1/1993 Watanabe et al. ..... 313/269
5,214,349 5/1993 Sakata et al. ..... 313/407

*Primary Examiner*—Sandra L. O'Shea
*Assistant Examiner*—Vip Patel

[57] ABSTRACT

A color picture tube grid apparatus includes a mask, a frame, and a belt-like metal plate. The mask is constituted by an array of a large number of stretched grid elements defining a large number of slit holes. The frame has a pair of side frame portions for supporting the mask at two end portions of each of the grid elements in a stretching direction. The belt-like metal plate is in contact with end portions of the grid elements and arranged on at least one of two end portions of the mask to cross the array of grid elements.

2 Claims, 2 Drawing Sheets

COLOR PICTURE TUBE GRID APPARATUS HAVING A COLOR GRID WITH SLIT HOLES

BACKGROUND OF THE INVENTION

The present invention relates to a color picture tube grid apparatus and, more particularly, to a color picture tube grid apparatus having a color selection grid constituted by slit holes.

In a conventional color picture tube grid apparatus, as shown in FIG. 5, a pair of side frame portions 1 and 2, which are arranged to oppose each other at a predetermined distance, are supported by a pair of arm portions 3 and 4 at positions near the Bessel points of the side frame portions 1 and 2 so as to form a predetermined frame, and a mask 7 constituted by grid elements 5 having a predetermined tension distribution is stretched across the frame and is welded/supported thereon.

Since elongated slit holes 8 are formed between the grid elements 5, each grid element 5 is very narrow and arcuate and receives a tension to be susceptible to mechanical vibration and deformation. For this reason, when phosphors are to be formed on the panel surface, the grid elements are shaken by the vibration of an exposure base or the like. As a result, portions to be exposed are shifted, and the phosphors cannot be correctly formed on the panel surface.

It may be considered that exposure is performed after the above-mentioned vibration is attenuated almost completely. However, since it takes much time for the vibration to be completely attenuated, a deterioration in productively occurs. In addition, even in a product, if the grid elements 5 are shaken by an external shock or the like, an image is adversely affected.

In order to prevent the above vibration, at least one damper line 6 is used, as shown in FIG. 5. This damper line 6 is arranged to be almost perpendicular to the longitudinal direction of the grid elements 5. With the damper line 6, vibration can be quickly suppressed to prevent the shaking movement of the grid elements 5.

Although the use of a plurality of damper lines can prevent the vibration and deformation of the grid elements, the damper lines shield light from a light source in an exposing operation. As a result, no phosphors are formed on portions shaded with the damper lines or the phosphors on the portions become thinner than those on other portions, thus adversely affecting an image.

SUMMARY OF THE INVENTION

It is an object of the present invention to provide a color picture tube grid apparatus which prevents vibration and deformation of grid elements.

It is another object of the present invention to provide a color picture tube grid apparatus which allows phosphor stripes to be correctly formed so as to prevent color misregistration.

In order to achieve the above objects, according to the present invention, there is provided a color picture tube grid apparatus comprising a mask constituted by an array of a large number of stretched grid elements defining a large number of slit holes, a frame having a pair of side frame portions for supporting the mask at two end portions of each of the grid elements in a stretching direction, and a belt-like metal plate which is in contact with end portions of the grid elements and arranged on at least one of two end portions of the mask to cross the array of grid elements.

DESCRIPTION OF THE PREFERRED EMBODIMENTS

Figure 1A:
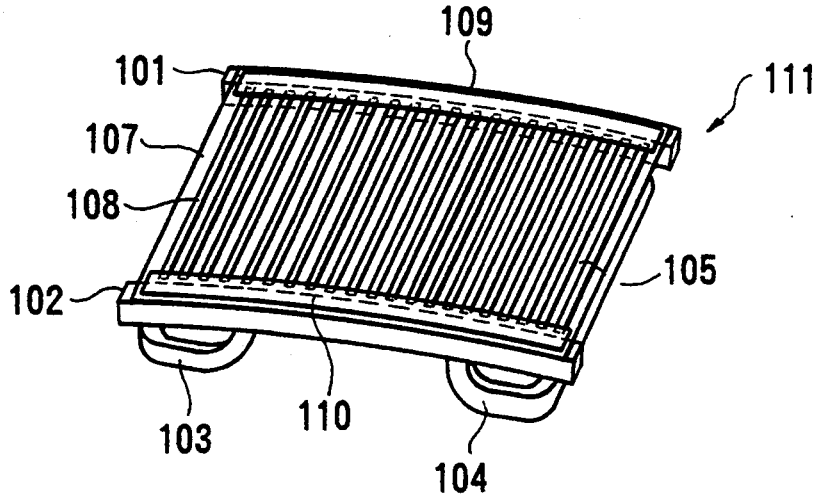
FIG. 1A is a perspective view of a grid apparatus according to the first embodiment of the present invention.
Figure 1B:
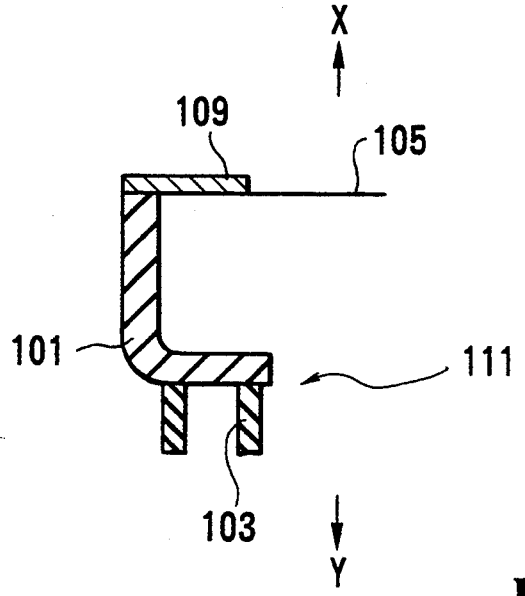
FIG. 1B is a sectional view showing the main part of the grid apparatus.

The present invention will be described below with reference to the accompanying drawings. FIG. 1A shows a grid apparatus according to an embodiment of the present invention. FIG. 1B shows the main part of the apparatus. This grid apparatus comprises a pair of side frame portions 101 and 102 arranged to oppose each other at a predetermined distance, a pair of U-shaped arm portions 103 and 104 supporting the side frame portions 101 and 102 at positions near their Bessel points, grid elements 105 constituted by ribbon-like metal strips, and belt-like metal plates 109 and 110 arranged on the side frame portions 101 and 102.

The side frame portions 101 and 102 and the arm portions 103 and 104 constitute a frame 111. The grid elements 105 are stretched across the frame 111 to constitute a mask 107. Slit holes 108 are formed between the grid elements 105. The mask 107 is supported by the side frame portions 101 and 102.

Consider each grid element 105 of the mask 107, used for this grid apparatus, as a single member. Upon reception of an external mechanical shock or vibration, each grid element 105 is deformed or resonated. As a result, portions to be exposed are shifted, and phosphor stripes cannot be formed at predetermined positions. Even if phosphor stripes are formed at predetermined positions, and a product is manufactured, each grid element 105 is vibrated by an external mechanical shock or vibration to cause color misregistration, thereby adversely affecting an image.

The present invention includes the belt-like metal plates 109 and 110 to quickly attenuate the vibration of the grid elements 105 described above. More specifically, the pair of belt-like metal plates 109 and 110 are arranged on the side frame portions 101 and 102 to cross the array of the grid elements 105 in such a manner that one side of each of the plates 109 and 110 extends from an upper portion of a corresponding one of the side frame portions 101 and 102 toward the inside of the frame 111, and each of the portions extending from the side frame portions 101 and 102 is in contact with one surface of one end portion of each grid element 105. With this arrangement, the grid elements 105 are vibrated on the extended portions, of the belt-like metal plates 109 and 110, which serve as fulcrums in the direction indicated by an arrow X, while they are vibrated in the direction indicated by an arrow Y with support portions 107*a* and 107*b*, of the mask 107, which support the two ends of each grid element 105, serving as fulcrums. Therefore, the length of a chord which is vibrated in the upward and downward directions changes.

Figure 2:
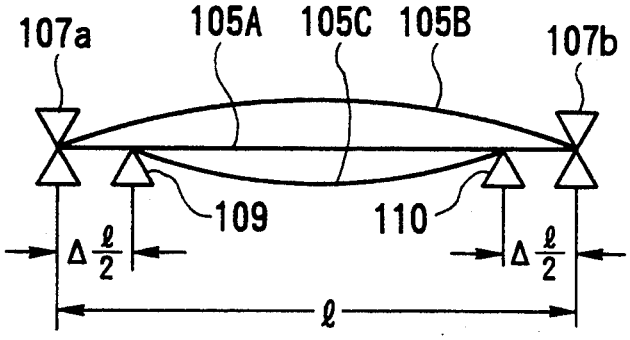
FIG. 2 is a view for explaining the principle of the present invention.

The principle of the operation will be described next. As shown in FIG. 2, each grid element 105 can be regarded as a chord 105A which vibrates. When the chord 105A vibrates on a side 105B, the portions connected with the mask 107 serve as fulcrums, and the chord 105A has a length l. However, when the chord 105A vibrates on a side 105C, the belt-like metal plates 109 and 110 serve as fulcrums, and the chord 105A has a length $l-\Delta l$. More specifically, when the chord 105A vibrates in the direction indicated by the arrow Y (on the electron gun side) shown in FIG. 1B, which direction corresponds to the side 105B, a frequency $w_1=(k\pi)/l\cdot\sqrt{(T/\sigma)}$ (T: tension, $\sigma$: line density, k=1, 2, 3 . . . ) is obtained. When the chord 105A vibrates in the direction indicated by the arrow X (on the panel side), which direction corresponds to the side 105C, the frequency $w_1$ is given by $w_1=(k\pi)/(l-\Delta l)\cdot\sqrt{(T/\sigma)}$. In this manner, the frequency of the chord 105A can be changed.

The value $\Delta l$ is set so that the relationship between l and $\Delta l$ avoids $l=k\Delta l$ (k=1, 2, 3, . . . ). When the present invention is to be executed, the length $l-\Delta l$ of an effective surface is determined first, and the length l of a chord is obtained next. With this arrangement, the vibration is quickly attenuated. Therefore, phosphor stripes can be accurately formed within a short period of time, and adverse effects on an image can be eliminated.

Figure 3:
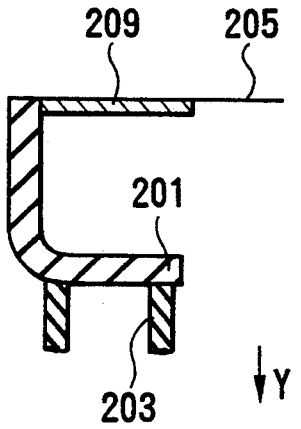
FIG. 3 is a sectional view showing the main part of the second embodiment of the present invention.

FIG. 3 shows the main part of the second embodiment of the present invention. In the second embodiment, a belt-like metal plate 209 is formed on the electron gun side of each grid element 205 (in the direction indicated by an arrow Y). Similar to the first embodiment, the vibration of the grid elements 205 can be quickly attenuated. Reference numeral 201 denotes a side frame portion; and 203, an arm portion.

Figure 4:
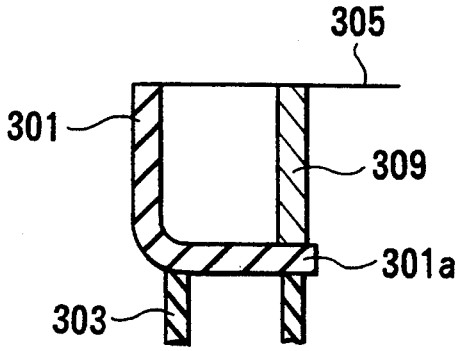
FIG. 4 is a sectional view showing the main part of the third embodiment of the present invention.
Figure 5:
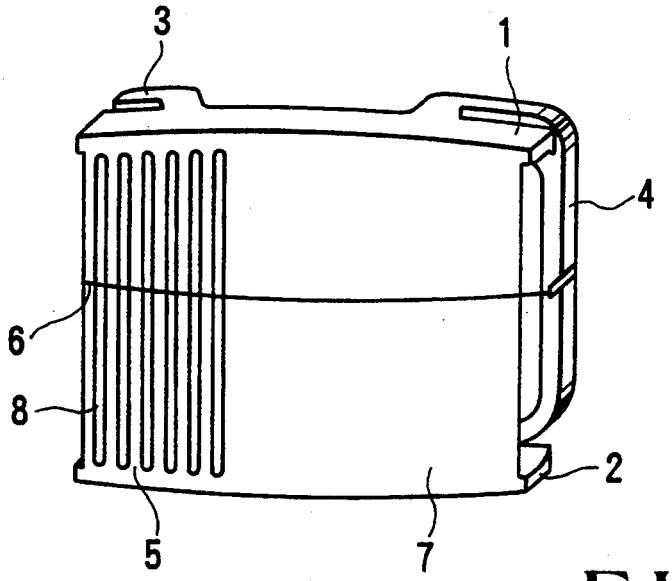
FIG.5 PRIOR ART
FIG. 5 is a perspective view of a conventional grid apparatus.

FIG. 4 shows the main part of the third embodiment of the present invention, in which a belt-like metal plate 309 is arranged to be almost vertical to each grid element 305, and is fixed to a bent portion **301*a* of a side frame portion 301** having an L-shaped cross-section. Similar to each embodiment described above, the vibration attenuating effect is high.

In each embodiment described above, a pair of belt-like metal plates are arranged on the two ends of a mask. However, even if a belt-like plate is arranged on only one end of a mask, the length of each grid element changes, thereby obtaining the same effects as described above.

As has been described above, according to the color picture tube grid apparatus of the present invention, in a combination of a mask having a large number of elongated slit holes in the longitudinal direction, and a frame constituted by side frame portions supporting the mask and arm portions supporting the side frame portions, at least one belt-like metal plate is arranged to be in contact with an end portion of one surface of each of grid elements constituting the elongated slit holes of the mask. With this arrangement, vibration and deformation of the grid elements can be prevented, thereby obtaining an excellent image.

What is claimed is:

1. A color picture grid apparatus comprising:

a mask constituted by an array of a large number of stretched grid elements defining a large number of slit holes;

a frame having a pair of L-shaped side frame members positioned opposite each other at a predetermined distance from each other for supporting said mask at two end portions of each of said grid elements in a stretching direction, and a pair of U-shaped arm members for supporting said side frame members at positions near Bessel points of said side frame members; and at least one belt-like metal plate associated with at least one of said side frame members and being parallel to an edge of said mask and being positioned so as to cross said array of said stretched grid elements, said at least one belt-like metal plate having a flat surface which is in contact with one surface of end portions of said grid elements over such a length in a direction of stretching of said grid elements as to quickly attenuate external mechanical shocks and vibrations of said grid elements, wherein said belt-like metal plate is arranged to be almost vertical to said mask, one end of said belt-like metal plate is fixed to a bent portion of said at least one of said side frame members, and another end of said belt-like metal plate is in contact with said one surface of an end portion of each of said grid elements.

2. An apparatus according to claim 1, wherein a pair of belt-like metal plates, each identical to said belt-like metal plate, are arranged on two end portions of said mask.

* * * * *